US006059491A

United States Patent [19]

Striefel et al.

[11] Patent Number: 6,059,491

[45] Date of Patent: May 9, 2000

[54] PORTABLE BARRIER

[76] Inventors: Richard R. Striefel, 26633 SE. Odell Rd.; Michael C. McKinney, 27522 SE. Highway 224, both of Eagle Creek, Oreg. 97022

[21] Appl. No.: 08/971,120

[22] Filed: Nov. 14, 1997

[51] Int. Cl.[7] ..... E01F 13/00; E02B 3/10

[52] U.S. Cl. ..... 405/111; 405/114; 404/6; 256/13.1

[58] Field of Search ..... 405/15, 16, 17, 405/21, 23, 25, 30, 31, 52, 107, 108, 110, 111, 114, 115, 116; 404/6; 256/13, 13.1

[56] References Cited

U.S. PATENT DOCUMENTS

| | | | |
|---|---|---|---|
| D. 341,098 | 11/1993 | Yodock . | |
| 1,902,741 | 3/1933 | Weber | 405/114 |
| 2,279,942 | 4/1942 | Hausherr . | |
| 3,503,600 | 3/1970 | Rich . | |
| 3,540,699 | 11/1970 | Guzzardella . | |
| 3,732,653 | 5/1973 | Pickett . | |
| 3,980,279 | 9/1976 | Bofinger . | |
| 4,059,362 | 11/1977 | Smith . | |
| 4,113,400 | 9/1978 | Smith . | |
| 4,406,563 | 9/1983 | Urlberger . | |
| 4,661,010 | 4/1987 | Almér et al. . | |
| 4,665,673 | 5/1987 | Diana . | |
| 4,681,302 | 7/1987 | Thompson . | |
| 4,685,656 | 8/1987 | Lee et al. . | |
| 4,762,438 | 8/1988 | Dewing . | |
| 4,773,629 | 9/1988 | Yodock . | |
| 4,784,520 | 11/1988 | Stevens | 405/107 |
| 4,869,617 | 9/1989 | Chiodo . | |
| 4,946,306 | 8/1990 | Yodock . | |
| 4,978,245 | 12/1990 | White | 404/6 |
| 5,011,325 | 4/1991 | Antonioli . | |
| 5,022,781 | 6/1991 | Smith . | |
| 5,123,773 | 6/1992 | Yodock . | |
| 5,425,594 | 6/1995 | Krage et al. | 256/13.1 |
| 5,452,963 | 9/1995 | Christensen | 256/13.1 |
| 5,622,448 | 4/1997 | Baum et al. | 405/114 |

*Primary Examiner*—David Bagnell
*Assistant Examiner*—Fredrick L. Lagman
*Attorney, Agent, or Firm*—Klarquist Sparkman Campbell Leigh & Whinston, LLP

[57] ABSTRACT

A portable barrier including an elongate hollow container providing a chamber for holding fluent material to increase its weight has a stabilizing toe projecting outwardly from one of its sidewalls with the upper surface of the toe disposed at an angle relative to the horizontal and angling downwardly on progressing away from sidewall. Hinged connectors are provide at opposite ends of the barrier for connecting to adjacent barriers, and angled endwalls accommodate angular orientation of adjacent connected barriers relative to each other. A plurality of bores permit fluid to flow pass the barrier as desired, or to be stopped by the insertion of plugs. A removable flexible cover is placed over the hinged interconnection between adjacent barriers. The cover may be of a water-proof or filtering medium as desired.

22 Claims, 3 Drawing Sheets

76
72
86
90
102
60
54
94
64
56
65
112
52
114
110c
62
110b
114
116
100
98
90
110
110a
112
116
110e
110d
70
84
114
108
74

PORTABLE BARRIER

FIELD OF THE INVENTION

This invention relates to a portable barrier which may be filled with fluent material to increase its weight for stability, and more specifically to such a barrier with added features which improves its utility.

BACKGROUND OF THE INVENTION

In the construction industry it often is desirable to have portable barriers which may be located in a selected position for a period of time and then moved. One use for such barriers is on construction sites where water may flow and it is necessary to either stem the flow of water to adjacent regions, or if such water is allowed to flow to provide some screening or filtration of the water such that silt, sediment, slurry, dirt, etc., does not move from the construction site onto adjacent property. Further, it may be desirable at times to provide for the impoundment of water, or other fluids.

In the past on construction sites it has been common to attempt to stem the flow of silt, slurry, etc., produced by water runoff by supporting sheets of filter cloth between upright post stretched across a region over which water may flow. Although this may stem some of the migration of dirt, silt, etc., from the construction site to adjacent property it has been found that the filter cloth and its supports often have insufficient stability to hold up over a period of time and often will be knocked over, torn, or merely have material flow therethrough causing problems on adjacent property.

SUMMARY OF THE INVENTION

A general object of the present invention is to provide a novel portable barrier which forms an elongate hollow container defining a chamber configured to receive and hold fluent material to increase the weight of the barrier for stability. The chamber is bounded by a pair of opposed substantially upright spaced-apart sidewalls and a stabilizing toe at the lower portion of one of the sidewalls projects outwardly therefrom, having an upper surface disposed at an angle in a range of about 10 to 45 degrees relative to the horizontal. Since the barrier is capable of receiving fluent material for increased weight it allows the barrier to be easily moved when empty, yet is stable when filled with fluent material. Further the projecting toe may have weights, such as sand bags, rested thereon to inhibit tipping. If the barrier is used as an impoundment device, silt or other materials may build up on the projecting toe, again to resist tipping of the barrier from its desired upright position.

Another object of the present invention is to provide such a novel portable barrier which may be connected to a similar adjacent barrier through an end connector and which has an angularly disposed endwall which permits the barriers to be disposed either in line or at a substantial angle relative to each other.

Yet another object of the present invention is to provide such a portable barrier which has a bore extending therethrough, through which a controlled flow of fluid may pass the barrier. The bore may be threaded to receive a fluid-tight plug or to have a filter connected thereto through which fluids may pass with a selected degree of filtration.

A further object of the present invention is to provide a novel portable barrier which may be releasably connected to an adjacent barrier in end-to-end relationship, and which includes a cover which extends between the adjacent end portions of the barriers to control fluid flow past the connector. The cover may be flexible to permit shifting of the barriers relative to each other and may be either water-tight to inhibit flow of fluid past the connectors, such as would be required in using the barrier for an impoundment device, or it may be made of filter cloth material through which a controlled flow of fluid may move past the connectors with a selected degree of filtration occurring.

A portable barrier is provided which is economic to manufacture and use, is easily portable, yet when filled with a fluent material is weighted for stability and has the novel features and advantages set out above.

These and other objects and advantages will become more fully apparent as the following description is read in conjunction with the drawings.

DETAILED DESCRIPTION OF PREFERRED EMBODIMENT OF THE INVENTION

Figure 2:
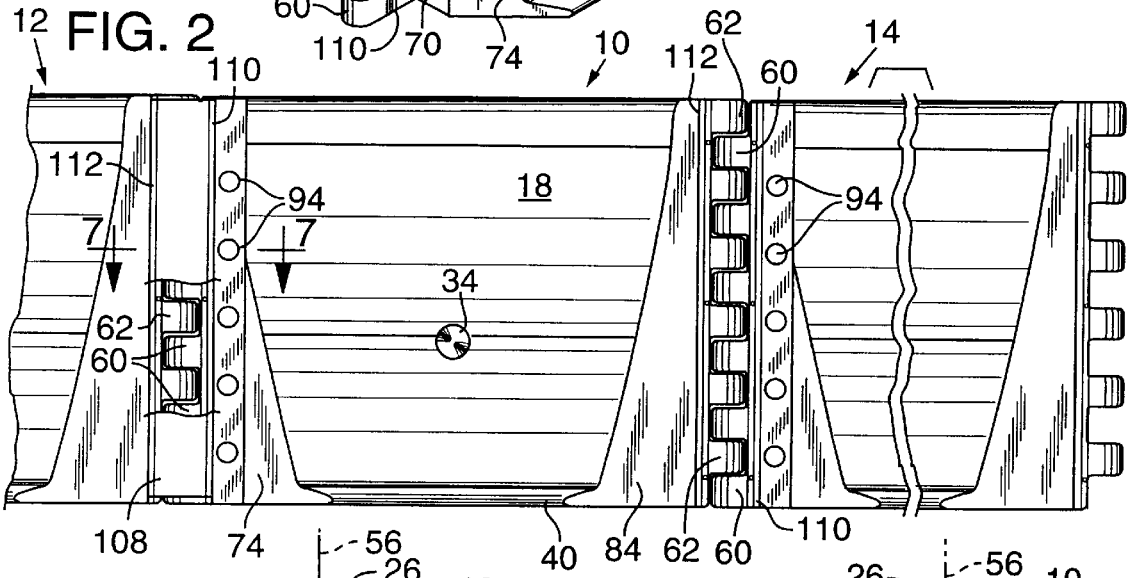
FIG. 2 is a face elevation view of the barrier connected to similar adjacent barriers in end-to-end relationships.
Figure 5:
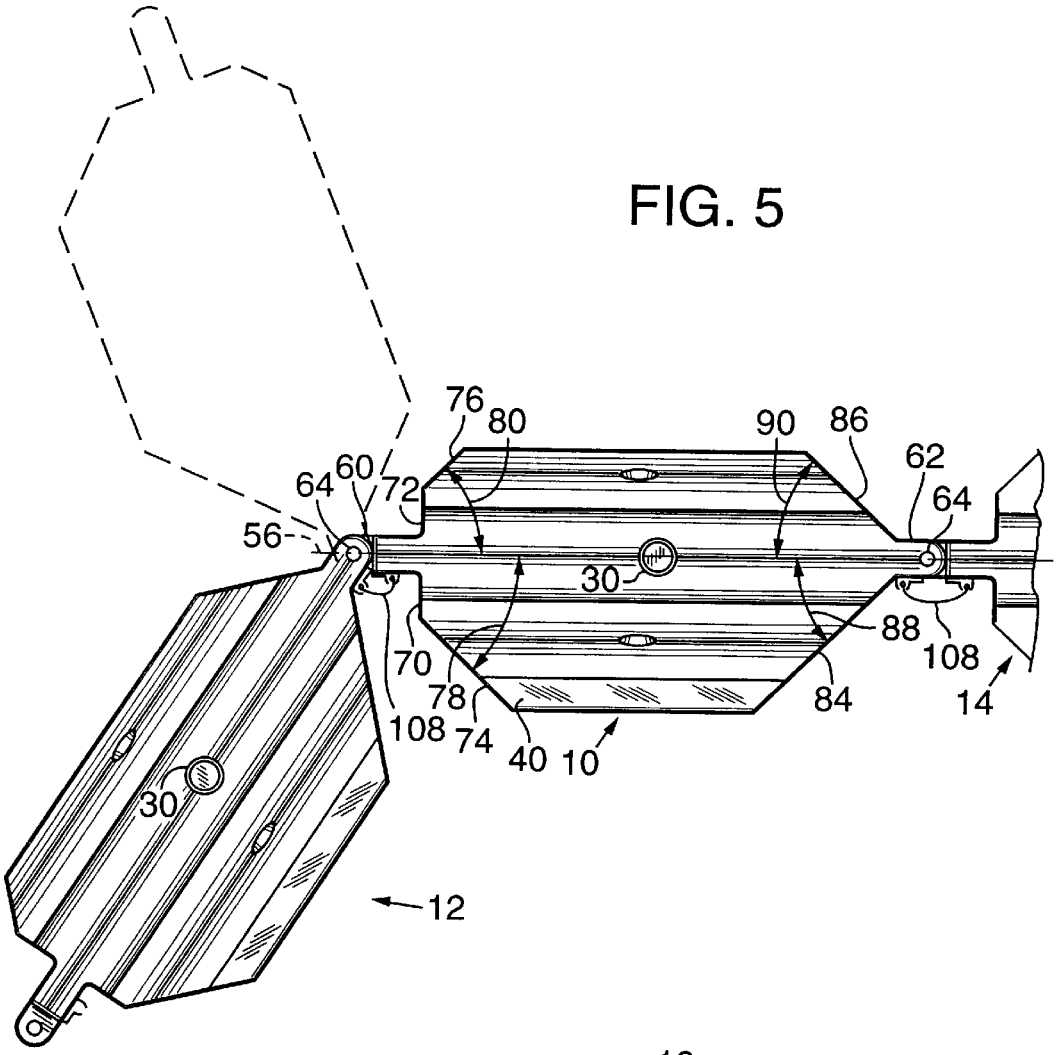
FIG. 5 is a top plan view of the barrier connected to adjacent barriers, with the central barrier substantially aligned longitudinally with the barrier to one side of the figure, and in an angularly disposed relationship with the barrier at the other side of figure.

At 10 is indicated generally a barrier constructed according to an embodiment of the invention. In FIGS. 2 and 5, the barrier 10 is illustrated connected at its opposite ends to similar adjacent barriers 12, 14 as will be described in greater detail below.

Figure 6:
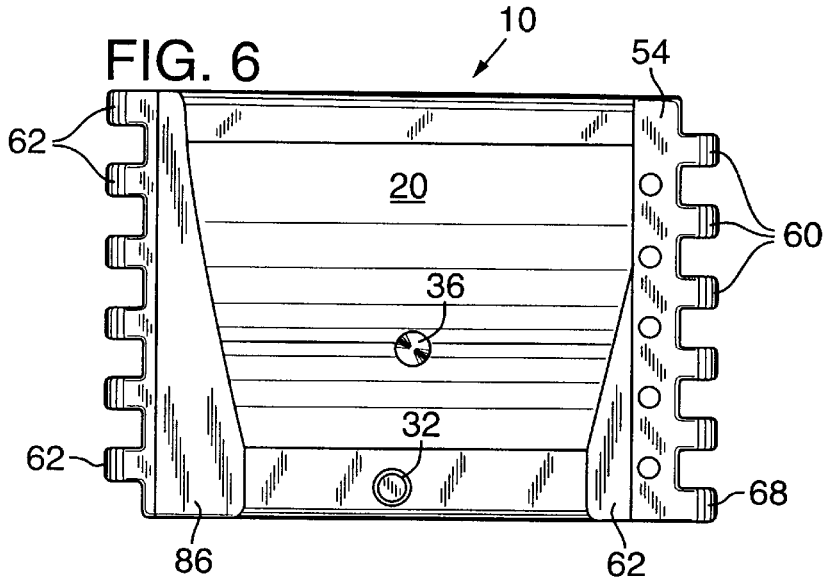
FIG. 6 is an elevation view of a face of the barrier opposite the face seen in FIGS. 1 and 2.

Describing barrier 10, it is a hollow molded plastic container, having a pair of substantially upright spaced-apart opposed sidewalls 18, 20. The barrier also has a substantially planar horizontal bottom wall 24, and a substantially horizontal top wall 26. The top wall 26 has a threaded opening 28 therein which may be closed by a threaded plug 30. Referring to FIG. 6, the lower portion of wall 20 has a bore in which a threaded plug 32 is removably received. As can be seen in the drawings at least the lower one-third of the height of sidewall 18 has a substantially unbroken surface expanse which diverges from an upright central plane 56 on progressing downwardly.

Figure 4:
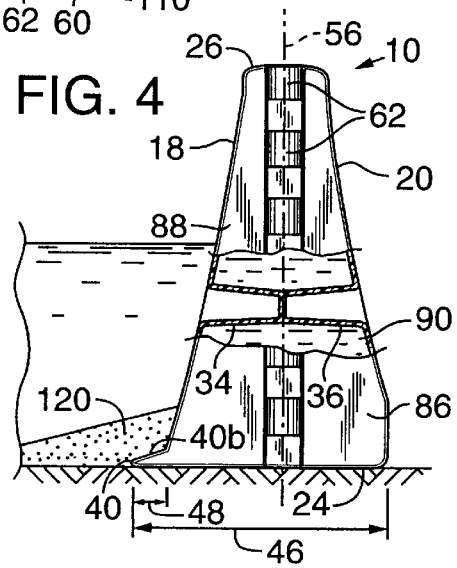
FIG. 4 is an end elevation view of the barrier taken from the end opposite the viewer in FIG. 1.

As seen in FIG. 4, a pair of conically shaped portions 34, 36 extend inwardly from opposite sides 18, 20, respectively and are integrally joined at the center of the barrier to provide structural strength to resist bowing out of sidewalls 18, 20 as will be described below.

A stabilizing toe 40 projects laterally outwardly from the bottom portion of sidewall 18. The bottom surface of the toe 40*a* is a substantially horizontal extension of bottom wall 24 and is adapted to rest flush on the ground 42. The upper, or top, surface of the toe 40*b* angles downwardly on projecting outwardly away from sidewall 18 and is disposed at an angle 44 relative to the horizontal. This angle 44 may be in a range from 10 to 45 degrees, and more preferably is less than 30 degrees. As seen in FIG. 4, the overall bottom width of the barrier is indicated generally at 46. The distance which toe 40 projects outwardly beyond sidewall 18 is indicated generally at 48. In the illustrated embodiment width, or distance, 46, preferably may be in a range of 11 to 15 inches and distance, or width, 48 may be in a range of 2 to 5 inches. These dimensions are exemplary for a portable barrier of a general size of approximately three feet high by four to five feet long. In preferred embodiments distance 48 may be in a range of 0.15 to 0.40 times distance 46, and more preferably in a range of 0.20 to 0.33.

Referring to FIGS. 1, 2, 6 and 7, projecting longitudinally of the barrier and more closely spaced together than sidewalls 18, 20 are a pair of wing walls 52, 54 which are substantially parallel to each other and to a longitudinally extending substantially upright central plane 56 of the barrier.

Projecting longitudinally outwardly from wing walls 52, 54 are connectors, or hinge portions 60. The lowermost connector 60 is substantially flush with bottom surface 24. The remainder of the connectors 60 are aligned thereabove with spaces 61 therebetween. The connectors have vertically aligned bores 59 extending therethrough adapted to receive a pin, such as that indicated generally at 64, to connect the barrier to an adjacent barrier.

A plurality of connectors 62 at the opposite end of the barrier are similarly disposed extending longitudinally from the opposite end of the barrier. Connectors 62 are vertically aligned and have spaces 63 therebetween of a size to receive connectors such as those indicated at 60. The top connector 62 is substantially flush with the top 26 of the barrier and the lowermost connector 62 is spaced above bottom wall 24 a distance equal to the height of the lowermost connector 60 at the opposite end. Connectors 62 have vertically aligned bores 65 extending therethrough adapted to receive pin 64 also. It is a simple matter to position adjacent barriers, such as 10 and 12, and 10 and 14, with their connectors 60, 62 intermeshing as illustrated in FIG. 2 and insert a pin such as 64 through the aligned bores to provide a hinged, or pivot, connection between adjacent barriers.

Adjacent the end of the barrier contiguous to wing walls 52, 54 a pair of opposed upright endwall portions 70, 72 extend laterally therefrom perpendicular to central plane 56. Substantially upright endwall portions 74, 76 extend at an angle relative to their associated endwall portions 70, 72, with the angles relative to center plane 56 indicated generally at 78, 80, respectively. Angles 78, 80 preferably are less than 60 degrees, and more preferably under 50 degrees. In the embodiment shown they are approximately 45 degrees.

At the opposite end of the barrier substantially upright endwall portions 84, 86 extend away from connector 62 at angles indicated generally at 88 and 90. Angles 88 and 90 preferably are less than 60 degrees, and in the illustrated embodiment are approximately 45 degrees.

Figure 1:
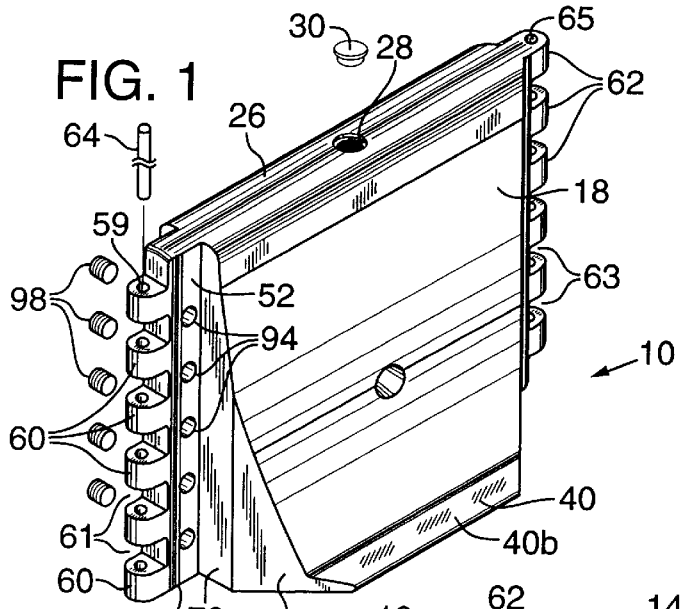
FIG. 1 is a perspective view of a portable barrier according to an embodiment of the invention.

As is best seen in FIGS. 1, 2 and 5, endwall portions 74, 84 project outwardly to form opposed converging endwalls for stabilizing toe 40.

Figure 7:
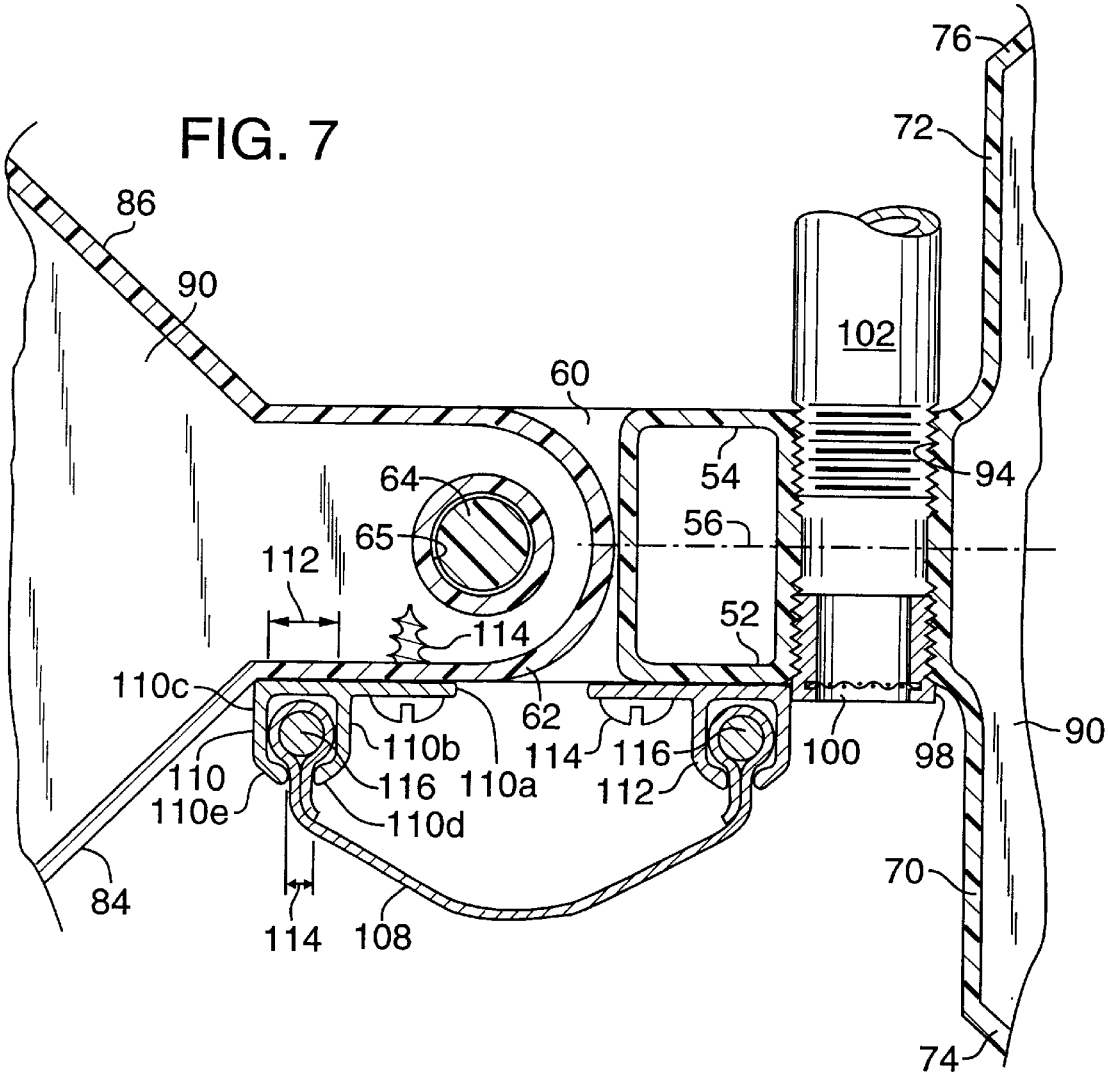
FIG. 7 is an enlarged cross-sectional view taken generally along the lines 7—7 in FIG. 2.

The walls for the barrier thus far described provide a hollow container forming a chamber indicated generally at 90 in FIGS. 4 and 7 operable to receive fluent material, such as water, through port 28, and from which fluent material may be emptied by removal of plug 32 from its associated opening. The barrier may be formed of rotationally molded plastic or other suitable material. Conical projections 34, 36 are integrally connected at their inwardly directed ends and serve to stabilize the opposed sidewalls 18, 20. Explaining further, when fluent material, such as water, is placed in chamber 90 fluid pressure urges walls 18, 20 transversely outwardly away from central plane 56 and away from each other. The integrally connected conical portions 34, 36 resist this outward movement.

Referring to FIGS. 1, 2 and 7, a plurality of threaded bores, or apertures, 94 are formed by cylindrical fluid-tight walls extending between wing walls 52, 54 which segregate bores 94 from chamber 90.

A plurality of externally threaded water-tight plugs 98 are indicated in FIG. 1 which may be screwed into bores 94 to close them off, or they may be removed to allow passage of fluid therethrough as will be described below.

As seen in FIG. 7, a screw-in cylinder 98 having a fine mesh screen 100 secured therein may be inserted into bore 94 to allow fluid to flow therethrough to provide a selected degree of filtration or screening. Additionally, or in place of cylinder 98, an outlet pipe 102 is shown screwed into the downstream side of bore 94. Explaining further, this outlet tube may be connected to a fluid filtration system, such that fluid flowing through a bore 94 and into outlet pipe 102 would flow into the filtration system which would allow the fluid, such as runoff water, to be filtered and cleaned before discharge.

Referring to FIGS. 2, 5 and 7, a flexible cover sheet 108 is attached at its opposite edges to barriers 10, 12 and covers what will be considered here the upstream side of connectors 60, 62. Referring to FIGS. 2 and 7, each of the adjacent connector ends of barriers 10, 12 have elongate, upright, attaching devices, in the forms of channel members, 110, 112 secured thereto, as by screws 114. The channels 110, 112 are similar, and thus only one will be described in detail.

Channel 110 has a base portion 110*a* and opposed flanges 110*b*, 110*c* extending substantially perpendicularly outwardly therefrom. Flanges 110*b*, 110*c* define a sleeve having a first width 112 therebetween. The outer end edge portions 110*d*, 100*e* of the flanges extend inwardly toward each other to produce a slot having a second width 114 which is narrower than the first width 112.

Cover 108 is a sheet of flexible material. Enlarged elements 116, which may be elongate rods, are secured in opposed edge margins of the sheet to produce edge margin portions for cover 108 which are slightly narrower than width 112, and thus slide easily therein. However, these marginal edge portions with rods 116 therein are larger in cross-section than the second width 114 so that they are retained in the space between edge portions 110*d*, 110*e* of the flanges. The cover 108 extends outwardly between edges 110*d*, 110*e* and is slidable vertically therein. The cover 108 has a height generally similar to the height of the barriers so that it extends continuously from a region adjacent bottom surface 24 to a region adjacent top surface 26. In FIG. 2 a central portion of the cover has been broken away to illustrate the position of connectors 60, 62.

Cover 108 may be a sheet of water-proof material, such that it can provide a water proof barrier over the connections between adjacent barriers 10, 12 and 10, 14. Alternately, cover 108 could be made of filter cloth material, such as the material known generally in the construction industry as Siltscreen, which would allow water to flow therethrough past the interconnection between adjacent barriers, but would inhibit the passage of silt, dirt, etc.

Explaining operation of the barrier system described, the barriers without fluent material therein are light enough to be easily handled and positioned, either in line with each other or at a selected angular position as illustrated in FIG. 5. The hinged connections and angled end walls permit a wide range of relative angular positioning between adjacent barriers. After the barriers have been positioned as desired, a barrier 10 is hingely connected to adjacent barriers 12, 14 as needed by pins 64 and cover 108 is slid into channel member 110, 112 to cover the interconnection therebetween. Fluent material, such as water, then is introduced to the interior chamber 90 of each of the barriers to add weight to the barriers for stability. Plug 30 then is inserted. If the barriers are to be used for impounding water or other fluids, water-tight plugs 98 would be screwed into bores 94, and a cover made of a water-proof material 108 would be positioned on the upstream side of the barriers. The substantially horizontal planar bottom surface 24 of the barrier fits substantially flush with ground surface 42. Thus a generally water-tight barrier is provided.

If the barriers are to be used merely to inhibit the flow of fluids, such as ground water, from a construction site, the cover 108 may be made of a filtering cloth material and a filter plug such as that indicated at 98, or a filter outlet pipe and filtration system such as indicated generally at 102, may be connected to bores 94. Free flow of water from the site thus is inhibited and that allowed to pass the barrier will have a degree of filtration.

Figure 3:
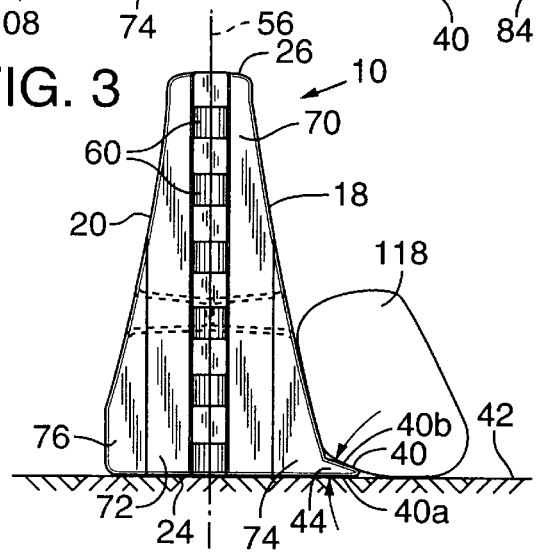
FIG. 3 is an end elevation view of the barrier taken from the end nearest the viewer in FIG. 1.

As illustrated in FIG. 3, extra weight such as a sand bag 118 may be placed on stabilizing toe 40 to provide extra stabilization against over-turning of the barrier. The bag rests atop toe 40.

In FIG. 4, a different form of counter-weighting on toe 40 is illustrated. Here where the barrier has formed an impoundment for water at its upstream side 18, silt or other material as indicated at 120, may build up on the upstream side of the barrier and lie atop toe 40 to provide added weight and thus additional resistance to tipping of the barrier in a downstream direction toward side 20.

While a preferred embodiment of the invention has been described herein, it should be apparent to those skilled in the art that variations and modifications are possible without departing from the spirit of the invention.

What is claimed is:

1. A portable barrier comprising an elongate hollow container defining a chamber configured to receive and hold fluent material to increase the weight of the barrier for stability, said chamber being bounded by a pair of opposed substantially upright spaced-apart sidewalls, with at least one of said sidewalls having a substantially unbroken surface expanse throughout the lower one-third of its height, and a stabilizing toe at the lower portion of said one of said sidewalls projecting outwardly therefrom having an upper surface disposed at an angle in a range of from about 10 to 45 degrees relative to the horizontal.

2. The barrier of claim 1, wherein the upper surface of the toe is disposed at an angle less than 30 degrees to the horizontal, sloping downwardly on progressing away from remainder portions of said sidewall.

3. The barrier of claim 1, wherein said container has a selected width adjacent the bottom of the barrier and said toe projects outwardly from said one sidewall a distance in a range of 0.15 to 0.40 times said selected width.

4. The barrier of claim 1, wherein said toe projects outwardly from said sidewall a distance of at least two inches.

5. The barrier of claim 1, which further comprises a connector for connecting an end portion of said barrier to an end portion of an adjacent barrier and a cover which extends between said end portions of said barriers to cover at least a portion of said connector to control fluid flow past said connector.

6. The barrier of claim 5, wherein an attaching device is mounted on said end portion of said barrier for attaching an edge portion of said cover to said barrier.

7. A portable barrier comprising an elongate hollow container defining a chamber configured to receive and hold fluent material to increase the weight of the barrier for stability, said chamber being bounded by a pair of opposed substantially upright spaced-apart sidewalls, a stabilizing toe at the lower portion of one of said sidewalls projecting outwardly therefrom having an upper surface disposed at an angle in a range of from about 10 to 45 degrees relative to the horizontal, a connector at one end thereof for connecting a second barrier to said one end, said connector occupying an upright plane extending longitudinally of the barrier, and an endwall portion extending away from said connector to one side of said plane at an angle relative to said plane to provide clearance to permit said barriers to be positioned at an angle relative to each other when connected.

8. The barrier of claim 7, wherein said angle is less than 60 degrees.

9. The barrier of claim 7, wherein said angle is less than 50 degrees.

10. The barrier of claim 7, wherein said endwall portion extends outwardly to define an endwall of said toe and the toe has an opposed endwall portion at its opposite end, which endwall portions converge on progressing outwardly from said sidewall.

11. A portable barrier comprising an elongate hollow container defining a chamber configured to receive and hold fluent material to increase the weight of the barrier for stability, said chamber being bounded by a pair of opposed substantially upright spaced-apart sidewalls, a stabilizing toe at the lower portion of one of said sidewalls projecting outwardly therefrom having an upper surface disposed at an angle in a range of from about 10 to 45 degrees relative to the horizontal, a bore extending through the barrier having a fluid-tight wall segregating the bore from the chamber, and a filter connected to said bore operable to provide a selected degree of filtration of fluid which passes through the bore.

12. A portable barrier comprising an elongate hollow container defining a chamber configured to receive and hold fluent material to increase the weight of the barrier for stability, said chamber being bounded by a pair of opposed substantially upright spaced-apart sidewalls, a stabilizing toe at the lower portion of one of said sidewalls projecting outwardly therefrom having an upper surface disposed at an angle in a range of from about 10 to 45 degrees relative to the horizontal, a bore extending through the barrier having a fluid-tight wall segregating the bore from the chamber, and a liquid impervious plug sealingly inserted in said bore to inhibit liquid flow therethrough.

13. A portable barrier comprising an elongate hollow container defining a chamber configured to receive and hold fluent material to increase the weight of the barrier for stability, said chamber being bounded by a pair of opposed substantially upright spaced-apart sidewalls, a stabilizing toe at the lower portion of one of said sidewalls projecting outwardly therefrom having an upper surface disposed at an angle in a range of from about 10 to 45 degrees relative to the horizontal, a connector for connecting an end portion of said barrier to an end portion of an adjacent barrier and a cover which extends between said end portions of said barriers to cover at least a portion of said connector to control fluid flow past said connector, an attaching device is mounted on said end portion of said barrier for attaching an edge portion of said cover to said barrier, and said cover comprises a sheet of flexible material and said attaching device comprises an elongate channel member secured to said end portion operable to receive and retain said edge portion of said cover.

14. The barrier of claim 13, wherein said channel member has a base portion secured to said end portion of the barrier and opposed flanges extending outwardly therefrom producing a sleeve of a first width, said flanges having outer edge portions which extend inwardly toward each other to provide a slot therebetween having a second width narrower than said first width, and an edge portion of the cover has an enlarged portion smaller in cross section than said first width but larger than said second width to slide within the sleeve and the portion of the cover adjacent said edge is thinner than said slot to extend outwardly from the channel.

15. The barrier of claim 13, wherein said cover comprises a sheet of waterproof material.

16. The barrier of claim 13, wherein said cover comprises a sheet of filter material to permit controlled passing of fluid therethrough and to produce filtering thereof as it passes.

17. A portable barrier system comprising a first elongate hollow container defining a chamber configured to receive and hold fluent material to increase the weight thereof for stability and having a connector at one end thereof, a second elongate hollow container defining a chamber configured to receive and hold fluent material to increase the weight thereof and having a connector at one end thereof for connecting to the connector on said first container to attach said containers, a flexible cover which extends between said containers to cover at least a portion of said connectors to control fluid flow past said connectors, a first attaching device mounted on said first container adjacent its associated connector, a second attaching device mounted on said second container adjacent its associated connector, and wherein said flexible cover has opposed edge margins retained by said attaching devices to position said flexible cover over said joined connectors.

18. The barrier system of claim 17, wherein an attaching device comprises a channel member having a base portion and opposed flanges extending outwardly therefrom producing a sleeve of a first width, said flanges having outer edges which extend inwardly toward each other to provide a slot therebetween having a second width narrower than said first width, and an edge margin of the cover has an enlarged portion smaller in cross section than said first width but larger than said second width adapted to slide within the sleeve and a portion of the cover adjacent said edge margin is thinner than said slot to extend outwardly from the channel.

19. The barrier system of claim 17, wherein said cover comprises a sheet of waterproof material.

20. The barrier system of claim 17, wherein said cover comprises a sheet of filter material operable to permit controlled passing of fluid therethrough to produce filtering as it passes.

21. A portable barrier comprising an elongate hollow fluid-tight container defining a chamber configured to receive and hold fluent material to increase the weight of the barrier for stability, said chamber being bounded by a pair of opposed spaced-apart substantially upright sidewalls, a bore extending through the barrier having a fluid-tight wall segregating the bore from the chamber to permit selected fluid flow through the barrier, and filter medium connected to said bore operable to produce selected filtration of fluid which passes through the bore.

22. A portable barrier comprising an elongate container defining a fluid-tight chamber configured to receive fluent material to increase the weight of the barrier for stability, said chamber being bounded by a pair of opposed substantially upright spaced-apart sidewalls, a stabilizing toe at the lower portion of one of said sidewalls projecting outwardly therefrom having an upper surface which inclines downwardly on progressing outwardly from said sidewall portion disposed at an angle in a range of 10 to 45 degrees relative to the horizontal and a substantially horizontally disposed bottom surface positioned to rest against the ground, a connector at one end thereof for connecting to a second adjacent barrier, said connector occupying an upright plane extending longitudinally of the barrier, an endwall portion extending away from the connector to one side of the plane at an angle of less than 60 degrees relative to the plane to provide clearance to permit said barrier to be positioned at an angle relative to an adjacent barrier to which it may be connected, and a flexible cover attached along an edge portion thereof to said barrier adjacent said connector and operable to be extended across a connection between said barrier and an adjacent barrier to control fluid flow past said connector.

* * * * *